US011688576B2

(12) United States Patent
Yan et al.

(10) Patent No.: US 11,688,576 B2
(45) Date of Patent: Jun. 27, 2023

(54) STRUCTURE OF GROUND FAULT CIRCUIT INTERRUPTER

(71) Applicant: Jiangsu General Protecht Co., Ltd., Suzhou (CN)

(72) Inventors: Hua Yan, Suzhou (CN); Bin Chen, Suzhou (CN); Sufeng Cai, Suzhou (CN)

(73) Assignee: JIANGSU GENERAL PROTECHT CO., LTD., Suzhou (CN)

( * ) Notice: Subject to any disclaimer, the term of this patent is extended or adjusted under 35 U.S.C. 154(b) by 0 days.

(21) Appl. No.: 17/639,715

(22) PCT Filed: Sep. 2, 2020

(86) PCT No.: PCT/CN2020/000204
§ 371 (c)(1),
(2) Date: Mar. 2, 2022

(87) PCT Pub. No.: WO2021/093132
PCT Pub. Date: May 20, 2021

(65) Prior Publication Data

US 2022/0285118 A1 Sep. 8, 2022

(30) Foreign Application Priority Data

Nov. 11, 2019 (CN) ..... 201911095026.8

(51) Int. Cl.
*H01H 83/14* (2006.01)
*H01H 71/32* (2006.01)
(Continued)

(52) U.S. Cl.
CPC ..... *H01H 71/32* (2013.01); *H01H 71/505* (2013.01); *H01H 71/58* (2013.01); *H01H 83/14* (2013.01)

(58) Field of Classification Search
CPC ..... H01H 71/505; H01H 71/32; H01H 83/14
(Continued)

(56) References Cited

U.S. PATENT DOCUMENTS 6,946,935 B2 * 9/2005 Wu ..... H01H 83/04 361/42
7,170,375 B2 * 1/2007 Chen ..... H01H 89/08 335/38
(Continued)

FOREIGN PATENT DOCUMENTS

CN 1461032 12/2003
CN 102509919 6/2012
(Continued)

OTHER PUBLICATIONS

International Search Report filed in PCT/CN2020/000204 dated Nov. 25, 2020.

*Primary Examiner* — Alexander Talpalatski
(74) *Attorney, Agent, or Firm* — Rankin, Hill & Clark LLP

(57) ABSTRACT

A structure of a ground fault circuit interrupter includes a locking arm, which is provided with a stop surface, disposed inside the ground fault circuit interrupter, and a support body fixedly connected to a soft magnet is provided with a stop portion which can interfere with the stop surface that is moving downward. The locking arm is also connected to an elastic element, and under a normal state, the elastic element moves downward the stop surface of the locking arm to interfere with the stop portion of the support body, so that the soft magnet is prevented from moving toward a permanent magnet The locking arm can also be pushed down and driven by a reset button to move upward the stop surface, so that the stop portion and the stop surface no longer interfere with each other.

9 Claims, 9 Drawing Sheets

(51) Int. Cl.
*H01H 71/50* (2006.01)
*H01H 71/58* (2006.01)

(58) Field of Classification Search
USPC ..... 335/18
See application file for complete search history.

(56) References Cited

U.S. PATENT DOCUMENTS

| | | | | |
|---|---|---|---|---|
| 7,868,719 | B2 * | 1/2011 | Bazayev | H01H 9/0264 200/43.16 |
| 8,222,978 | B2 * | 7/2012 | Ku | H01H 83/02 335/177 |
| 2005/0264383 | A1 | 12/2005 | Zhang | |
| 2013/0021120 | A1 | 1/2013 | Chen | |

FOREIGN PATENT DOCUMENTS

| | | |
|---|---|---|
| CN | 209401892 | 9/2019 |
| CN | 210897173 | 6/2020 |

* cited by examiner

STRUCTURE OF GROUND FAULT CIRCUIT INTERRUPTER

TECHNICAL FIELD

The present invention relates to a structure of a ground fault circuit interrupter (GFCI).

BACKGROUND

A ground fault circuit interrupter (GFCI) can keep conducting contacts connected in a normal state, and can disconnect the conducting contacts by means of the magnetic force of an electromagnetic coil when a ground fault occurs, in order to effectively prevent the occurrence of an accident or disaster such as a personal electric shock or open circuit of electric equipment.

The structure of the ground fault circuit interrupter (GFCI) has been introduced in detail in typical ground fault circuit interrupters, e.g. CN815664A.

However, conventional ground fault circuit interrupters still have some shortcomings when in use.

For example, when a ground fault occurs, although the conventional ground fault circuit interrupters can disconnect the conducting contacts by means of the magnetic force of the electromagnetic coil, the conducting contacts may be re-connected if an external force is applied at this moment, causing the secondary occurrence of an accident or disaster such as a personal electric shock or open circuit of electric equipment, so there exist potential safety hazards.

SUMMARY

In view of the aforementioned fact, the present invention provides an improved structure of a ground fault circuit interrupter in order to prevent the uncontrolled connection of conducting contacts.

In order to achieve the above-mentioned object, the present invention adopts the following technical solution:

an improved structure of a ground fault circuit interrupter, a leakage protection action mechanism being disposed inside the ground fault circuit interrupter, the leakage protection action mechanism including a sleeve, a permanent magnet fixed at the position of one end of the sleeve, a soft magnet slidable in the sleeve, an elastic mechanism connected between the soft magnet and the sleeve and an action coil disposed outside the sleeve, and the ground fault circuit interrupter being further provided with a reset button capable of triggering the action coil, wherein a locking arm, which is provided with a stop surface, is also disposed inside the ground fault circuit interrupter, and a support body fixedly connected to the soft magnet is provided with a stop portion which can interfere with the stop surface that is moving downward;

the locking arm is also connected to an elastic element which in a normal state moves downward the stop surface of the locking arm to interfere with the stop portion of the support body so as to stop the soft magnet from moving toward the permanent magnet; and the locking arm can also be pushed down and driven by the reset button to move upward the stop surface too, so that the stop portion no longer interferes with the stop surface.

According to the improved structure of the ground fault circuit interrupter, a middle portion of the locking arm is fixed by a torsion beam, which forms the elastic element.

According to the improved structure of the ground fault circuit interrupter, a switching arm which can be pushed down by the reset button is disposed under the reset button, and one end of the switching arm is provided with a downward lug; and the locking arm is disposed under the switching arm, with one end being capable of coming into contact with the lug of the switching arm and the other end projecting downwards to form the stop surface.

According to the improved structure of the ground fault circuit interrupter, the back of the stop surface is provided with a slope, and/or a part of the stop portion which is connected to the back of the stop surface is provided with a slope.

According to the improved structure of the ground fault circuit interrupter, the support body is connected to a movable contact plate which can come into contact with a static contact plate fixed in position, so that a load circuit of the ground fault circuit interrupter is connected;

the support body fixedly connected to the soft magnet is provided with a pair of accommodating recesses which are separately disposed in parallel, with one spring being disposed in each accommodating recess, wherein two movable contacts are respectively fixed at both ends of the movable contact plate, with one side of each movable contact abutting against the extended end of one of the springs and a static contact being disposed opposite to the other side of each movable contact, and wherein the static contacts are fixed in position and connected to the load circuit.

According to the improved structure of the ground fault circuit interrupter, a safety door is arranged in each pair of power outlets of the ground fault circuit interrupter, and includes a baffle, a supporting frame and an elastic part;

the baffle is provided with a front slope and a rear slope which are in the same inclination direction and are separately disposed at the front and the rear, the lower end of the front slope has no obstruction, and the lower end of the rear slope is open for the simultaneous passage of a positive prong and a negative prong; a left slider and a right slider are disposed at a position between the front slope and rear slope of the baffle;

the supporting frame is provided with a front through hole and a rear through hole which are separately disposed at the front and the rear and respectively correspond to the positions of the front slope and the rear slope; a pair of slide ways are disposed respectively on the left side and right side of the supporting frame;

the baffle is disposed on the supporting frame, the sliders are connected to the slide ways, so that the baffle can slide relative to the supporting frame, and a pair of fulcrums are also formed at the positions where the sliders are in contact with the slide ways, so that the baffle can move like a seesaw on the supporting frame; and the elastic part abuts against the baffle, so that the sliders of the baffle receive an elastic force for returning to a higher position when located on the slide ways.

According to the improved structure of the ground fault circuit interrupter, the inclination direction of the bottoms of the sliders is opposite from the inclination direction of the front slope.

According to the improved structure of the ground fault circuit interrupter, a stop hook extends downward from a front end of the baffle, a front end of the supporting frame is provided with stop walls, and the stop hook can interfere with the stop walls of the supporting frame under the drive of the front slope going down, so that the baffle cannot move backward;

a pair of supporting wings are disposed at a rear end of the baffle, the rear end of the supporting frame is provided with stop notches, and the supporting wings can interfere with the stop notches of the supporting frame under the drive of the front slope going down, so that the baffle cannot move backward.

According to the improved structure of the ground fault circuit interrupter, auxiliary slide ways also extend from the rears of the stop notches, and the supporting wings can slide in the auxiliary slide ways, so that the baffle can steadily slide relative to the supporting frame.

The advantage of the present invention is as follows: if the reset button is not pressed, the switching arm will not come into contact with the locking arm, and the locking arm is kept in a horizontal state under the initial positioning action of the torsion beam (capable of being fixed on the sleeve through the supporting frame), so that the stop surface interferes with the stop portion of the support body; at this point, if the soft magnet encounters an external force or the soft magnet uncontrollably moves toward the permanent magnet due to circuit disorder, the soft magnet will not move thanks to the blocking effect of the stop surface, and therefore secondary damage as a result of accidentally connecting power will not take place.

Figure 1:
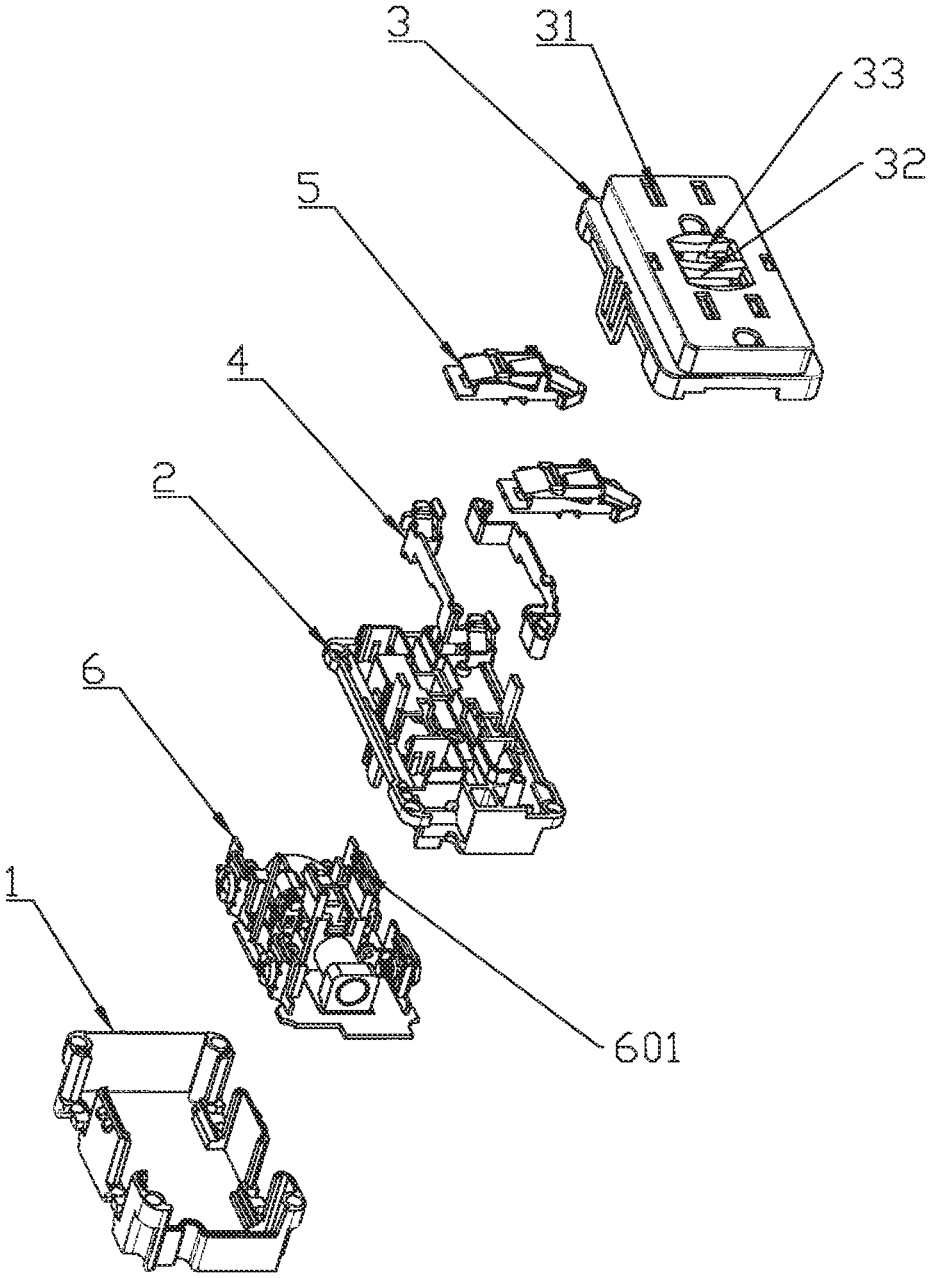
FIG. 1 is a three-dimensional exploded diagram of a ground fault circuit interrupter provided by the present invention.

DESCRIPTION OF REFERENCE NUMERALS bottom shell 1; middle shell 2; top cover 3; power outlet 31; reset button 32; test button 33; retaining wall 34; metal strip 4; safety door 5; leakage protection action mechanism 6; reset contact 601; transformer 61; sleeve 62; permanent magnet 63; soft magnet 64; elastic mechanism 65; action coil 66; support body 67; stop portion 671; accommodating recess 672; spring 673; movable contact plate 68; movable contact 681; static contact 691; switching arm 71; lug 711; locking arm 72; torsion beam 73; stop surface 74; slope 741; baffle 8; front slope 81; rear slope 82; slider 83; supporting wing 84; stop hook 85; supporting frame 9; front through hole 91; rear through hole 92; slide way 93; stop arm 931; auxiliary slide way 94; stop wall 95; stop notch 96; elastic part 99.

DETAILED DESCRIPTION

Some specific embodiments of the present invention will be described in detail blow in an exemplary rather than limiting way with reference to the drawings. In the drawings, the same reference numerals denote the same or similar parts or portions. It should be understood by those skilled in the art that these drawings are not necessarily drawn according to a true scale.

As shown in FIG. 1, a framework of a ground fault circuit interrupter is formed by sequentially assembling a bottom shell 1, a middle shell 2 and a top cover 3. Metal strips 4 are fixed on the middle shell 2. The top cover 3 is provided with power outlets 31. Safety doors 5 for preventing an accidental electric shock are disposed between the power outlets 31 and the metal strips 4. A leakage protection action mechanism 6 is fixed between the middle shell 2 and the bottom shell 1. The leakage protection action mechanism 6 passes through the middle shell 2 to form a reset contact 601. The top cover 3 is provided with a reset button 32 and a test button 33. When the reset button 32 is pressed, the reset contact 601 can come into a connected state.

Figure 2:
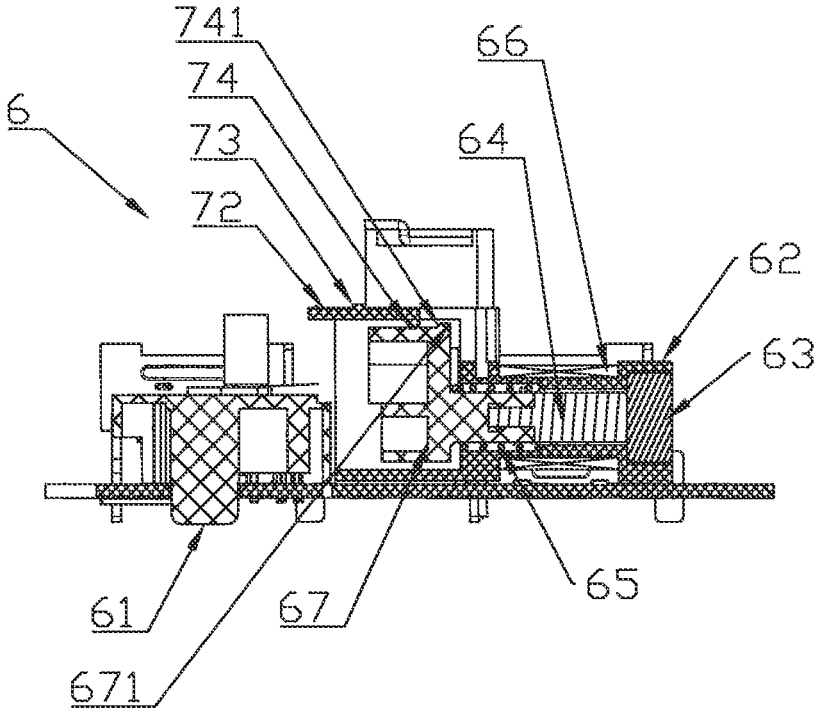
FIG. 2 and FIG. 3 are schematic structural diagrams of a leakage protection action mechanism in the on and off states of a load circuit respectively.
Figure 3:
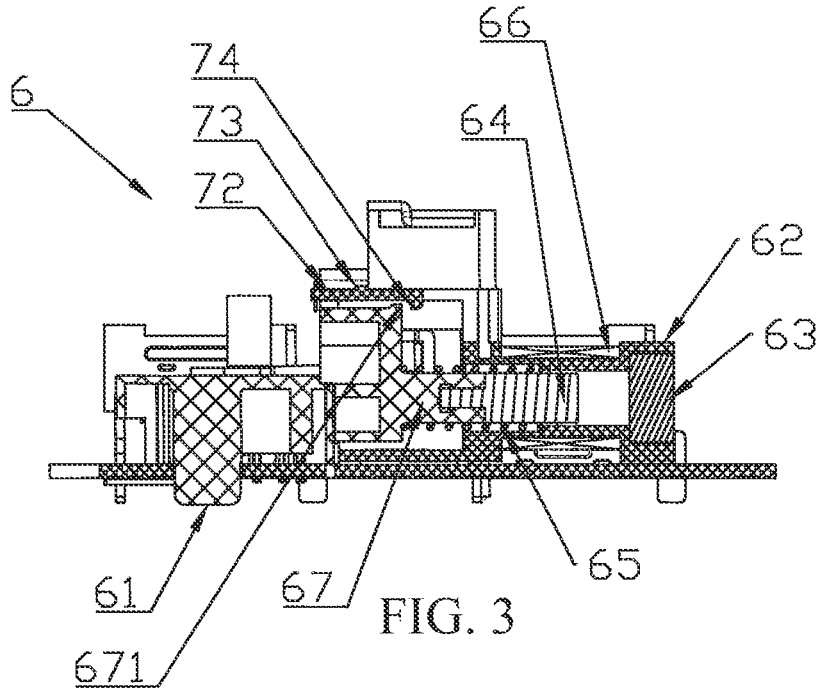

As shown in FIG. 2 and FIG. 3, the leakage protection action mechanism 6 includes a sleeve 62, a permanent magnet 63 fixed at one end of the sleeve 62, a soft magnet 64 capable of sliding in the sleeve 62, an elastic mechanism 65 connected between the soft magnet 64 and the sleeve 62, and an action coil 66 disposed outside the sleeve 62.

As shown in FIGS. 2 to 6, when the action coil 66 is electrified, the soft magnet 64 overcomes the resistance of the elastic mechanism 65 under the action of the magnetic force of the soft magnet 64 to attract the permanent magnet 63. At this point, movable contacts 681 of a movable contact plate 68 of a support body 67 fixedly connected to the soft magnet 64 come into contact with static contacts 691 of a static contact plate fixed in position, so that the ground fault circuit interrupter can output power to the outside.

When a fault occurs at a load end, a transformer 61 acquires a fault signal, so that the power of the action coil 66 is cut off and the soft magnet 64 is separated from the permanent magnet 63 under the action of the elastic mechanism 65, and consequently, the movable contacts 681 of the movable contact plate 68 of the support body 67 are out of contact with the static contacts 691 of the static contact plate fixed in position, so that the ground fault circuit interrupter no longer outputs power to the outside.

Under the fault state, if the soft magnet 64 encounters an external force or the soft magnet 64 uncontrollably moves toward and comes into contact with the permanent magnet 63 due to circuit disorder to make the ground fault circuit interrupter resume the output of power to the outside, secondary damage may brought to the fault point.

In order to prevent the occurrence of secondary damage, according to the present invention, a switching arm 71 is disposed under the reset button 32 and on the middle shell 2, and can be pushed down by the reset button 32. One end of the switching arm 71 is provided with a downward lug 711. A locking arm 72 is disposed under the switching arm 71, with the middle portion of the locking arm 72 being fixed through a torsion beam 73, one end being capable of coming into contact with the lug 711 of the switching arm 71 and the other end downwardly projecting to form a stop surface 74. The support body 67 fixedly connected to the soft magnet 64 is provided with a stop portion 671 capable of interfering with the stop surface 74. Under a normal state, the torsion beam 73 enables the stop surface 74 of the locking arm 72 to downwardly extend to a stop position. The torsion beam 73 may be replaced by other elastic elements.

If the reset button 32 is not pressed, the switching arm 71 will not come into contact with the locking arm 72, and the locking arm 72 is kept in a horizontal state under the initial positioning action of the torsion beam 73 (capable of being fixed on the sleeve 62), so that the stop surface 74 interferes with the stop portion 671 of the support body 67. At this point, if the soft magnet 64 encounters an external force or the soft magnet 64 uncontrollably moves toward the permanent magnet 63 due to circuit disorder, the soft magnet 64 will not move thanks to the blocking effect of the stop surface 74, and therefore secondary damage as a result of accidentally connecting power will not take place.

When an operator confirms that the fault has been eliminated, then the reset button 32 can be pressed, and as a result, the switching arm 71 is pushed down by the reset button 32. One end of the locking arm 72 is pushed down by the lug 711 of the switching arm 71, while the other end (i.e., the end provided with the stop surface 74) of the locking arm 72 goes up, leaving the support body 67 unblocked, and consequently, the soft magnet 64 can smoothly come into contact with the permanent magnet 63.

Once the reset button 32 is released, the stop surface 74 of the locking arm 72 returns to the stop position under the action of the torsion beam 73. When a fault occurs and the soft magnet 64 drives the support body 67 to move in a direction away from the permanent magnet 63, the support body 67 can slide along the slope 741 to push up the end of the locking arm 72 provided with the stop surface 74 and pass by, because the back of the stop surface 74 is provided with a slope 741 (the part of the stop portion 671 which is connected to the back of the stop surface 74 may also be provided with a slope). After the support body 67 passes by, the stop surface 74 of the locking arm 72 returns to the stop position again. This process is repeated again and again.

In addition, the present invention also improves the structure of the movable contact plate 68 of the ground fault circuit interrupter, so that the movable contact plate 68 and the static contact plate can receive force in equilibrium.

Figure 6:
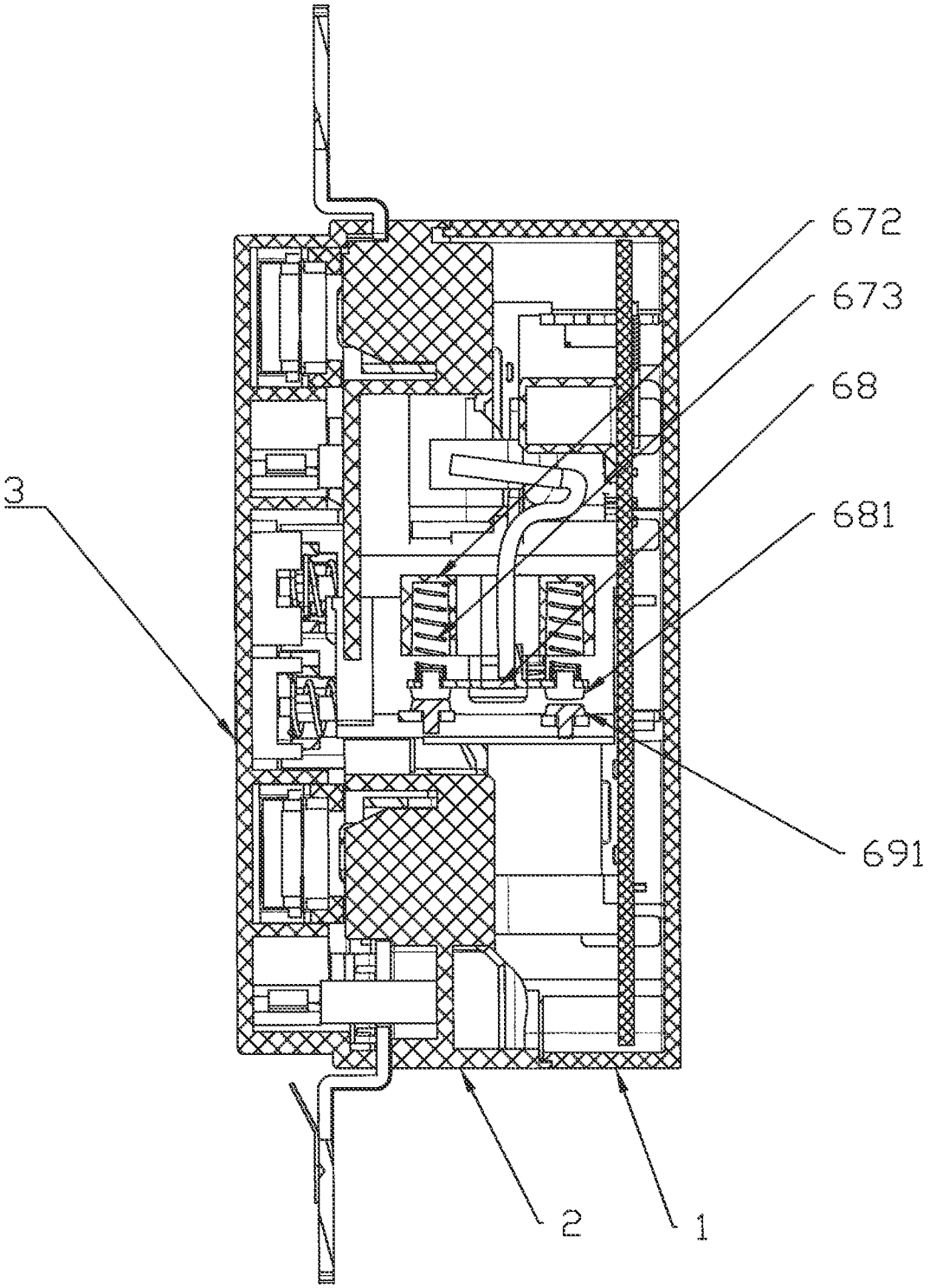
FIG. 6 and FIG. 7 are schematic diagrams of the action of connecting a movable contact plate and a static contact plate of the ground fault circuit interrupter provided by the present invention.
Figure 7:
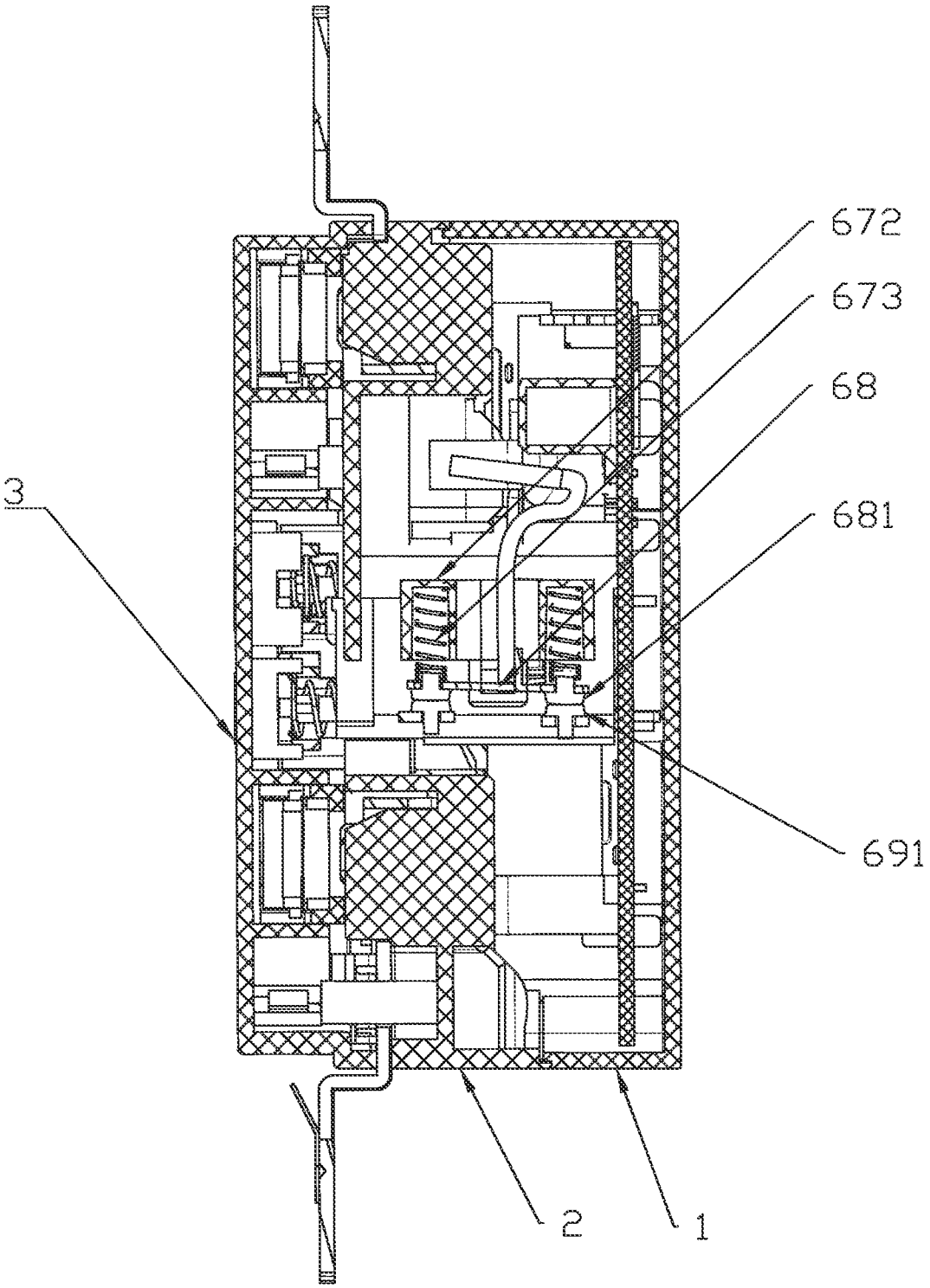

As shown in FIG. 6 and FIG. 7, the support body 67 fixedly connected to the soft magnet 64 is provided with a pair of accommodating recesses 672 which are separately disposed in parallel, with one spring 673 being disposed in each accommodating recess 672. Two movable contacts 681 are respectively fixed at both ends of the movable contact plate 68, with one side of each movable contact 681 abutting against the extended end of one spring 673 and the other side of each movable contact 681 disposed with a static contact 691. The static contacts 691 are fixed in position and connected to the load circuit.

Figure 4:
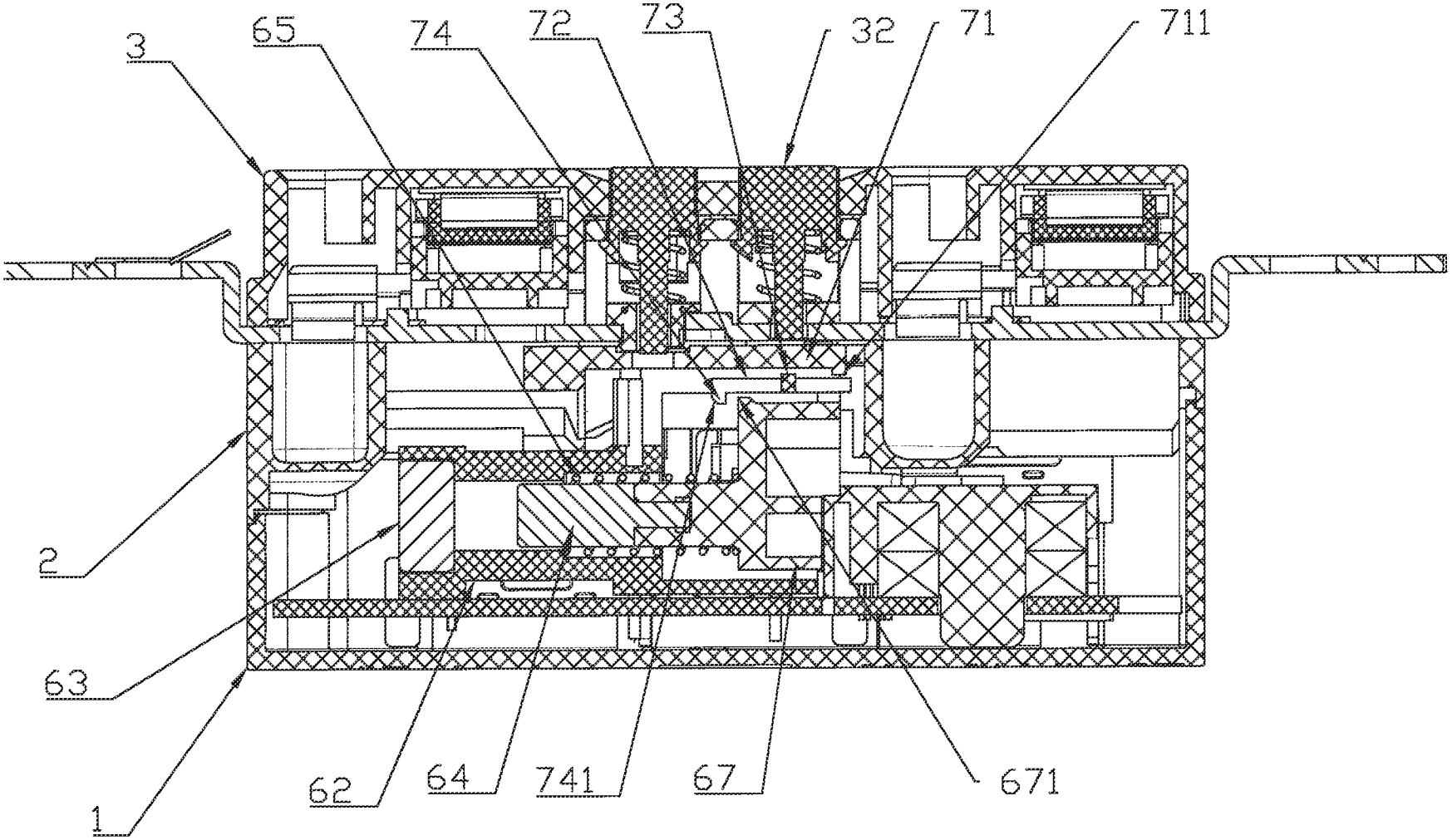
FIG. 4 and FIG. 5 are sectional structural diagrams of the ground fault circuit interrupter provided by the present invention before and after a reset button is pressed (compared with FIG. 1, a ground mounting iron plate is added)
Figure 5:
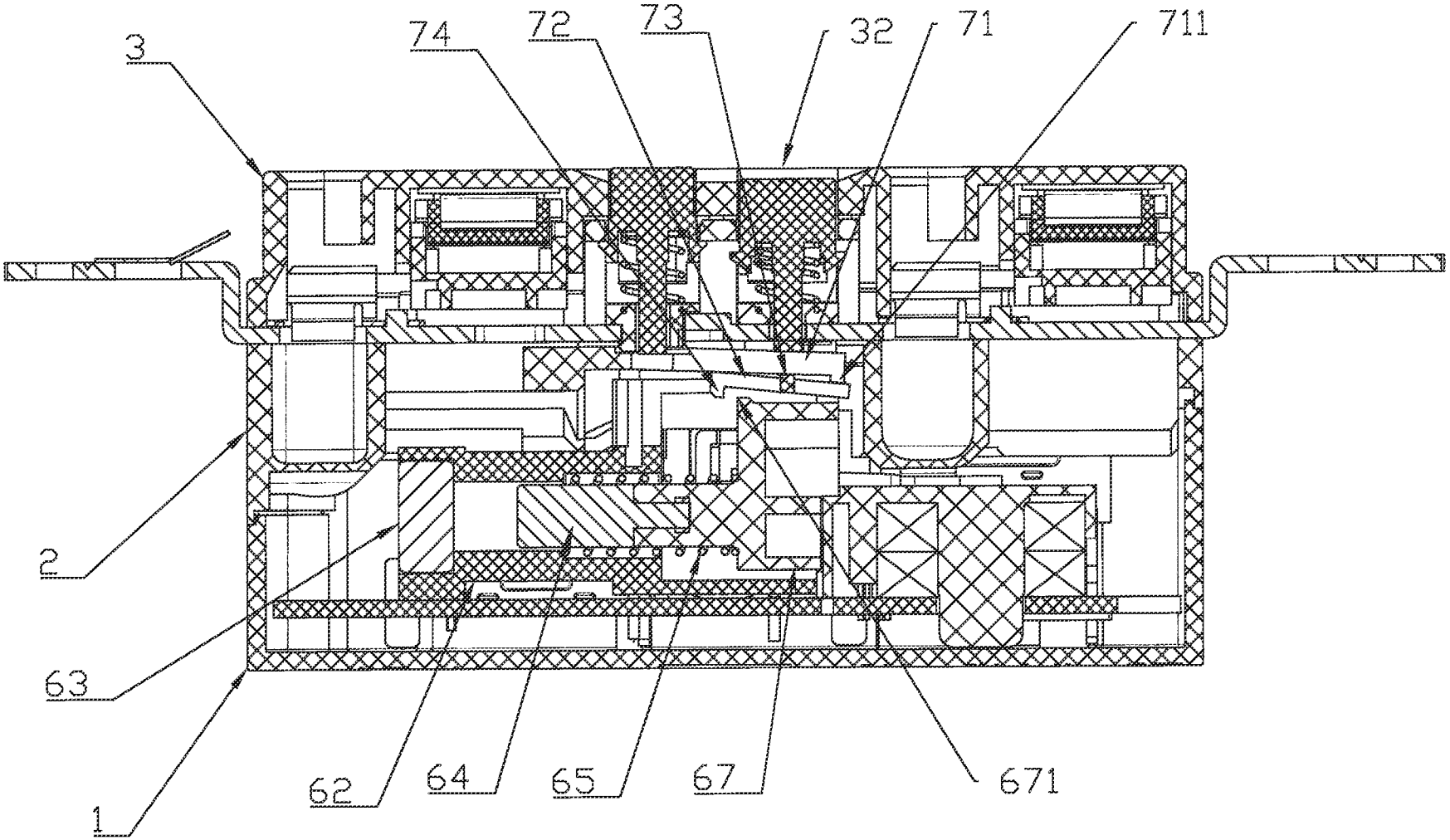

The support body 67 can reciprocate along with the soft magnet 64. When the two movable contacts 681 approach the static contacts 691, if one movable contact 681 comes into contact with one static contact 691 first due to deflection (as shown in FIG. 4), the spring 673 against which the movable contact 681 coming into contact first abuts, can be compressed as the support body 67 continues to approach, until the other movable contact 681 comes into contact with the other static contact 691 (as shown in FIG. 5). The support body 67 can still continue to approach until both springs 673 are compressed.

In this process, thanks to the presence of the springs 673, the balance of the movable contact plate 68 can be maintained to prevent the damage or failure of each contact as a result of forced squeezing. Further, the movable contacts 681 and the static contacts 691 can be attached to each other more tightly, so that it is not easy to produce gaps to cause an electric fire.

In order to prevent a baby or child from thrusting a conductive object (e.g., an iron wire) into the power outlets to accidentally get an electric shock, a safety door is designed inside each pair of power outlets, according to the present invention.

Figure 8:
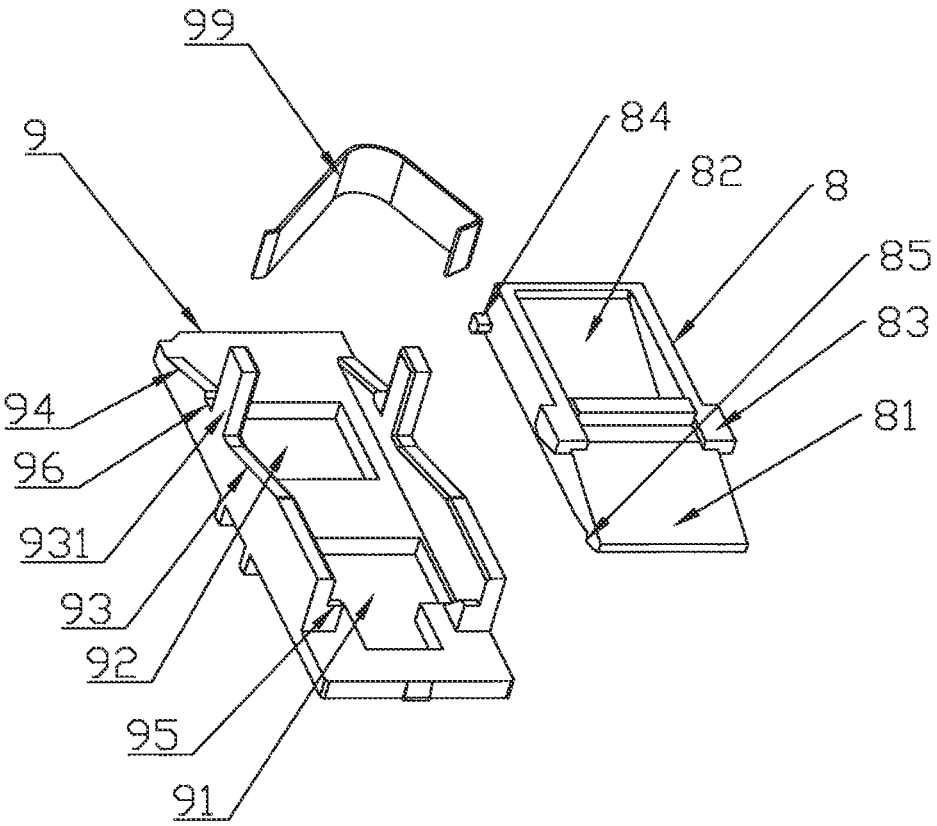
FIG. 8 and FIG. 9 are respectively schematic diagrams of an exploded structure and a combined structure of a safety door.
Figure 9:
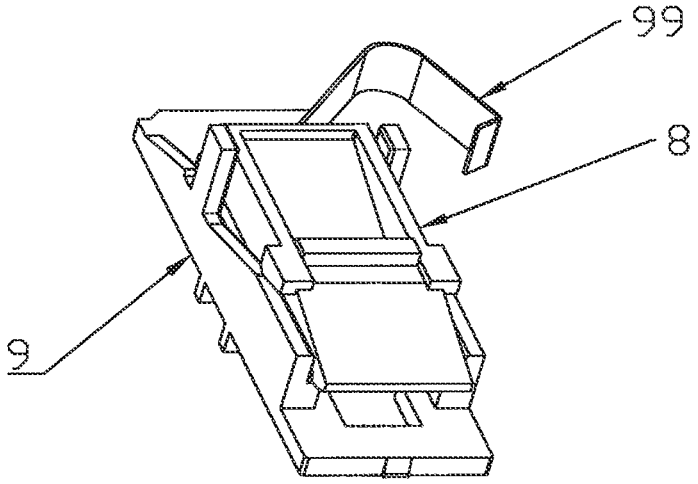

FIG. 8 and FIG. 9 are respectively schematic diagrams of an exploded structure and a combined structure of a safety door. The safety door includes a baffle 8 and a supporting frame 9.

The baffle 8 is provided with a front slope 81 and a rear slope 82 which are in the same inclination direction and are separately disposed at the front and the rear. The lower end of the front slope 81 has no obstruction, and the lower end of the rear slope 82 is open for the smooth passage of a positive prong and a negative prong on a plug. Sliders 83 are disposed on the left and right sides of the baffle 8 between the front slope 81 and the rear slope 82. The bottoms of the sliders 83 are preferably slopes with an inclination direction opposite from that of the front slope 81 and the rear slope 82.

The supporting frame 9 is provided with a front through hole 91 and a rear through hole 92 which are separately disposed at the front and the rear and respectively correspond to the positions of the front slope 81 and the rear slope 82. Slide ways 93 with an inclination direction opposite from that of the front slope 81 and the rear slope 82 are separately disposed at the front and the rear on the left side and right side of the supporting frame 9.

The baffle 8 is disposed on the supporting frame 9. The sliders 83 are connected to the slide ways 93, so that the baffle 8 can slide relative to the supporting frame 9. A pair of fulcrums are also formed at the positions where the sliders 83 are in contact with the slide ways 93, so that the baffle 8 can move like a seesaw on the supporting frame 9.

The baffle 8 also abuts against an elastic element 99 (e.g., an elastic strip) which can make the sliders 83 of the baffle 8 located on the slide ways 93 receive an elastic force for returning to the higher position.

As shown in FIGS. 8 to 11, the safety doors are installed in the top cover 3, the supporting frame 9 is fixed on the top cover 3, the baffle 8 is sandwiched between the upper side of the supporting frame 9 and the lower side of the top cover 3, and the elastic strip is fixed inside the top cover 3 and abuts against the rear end of the baffle 8, so that the baffle 8 tends to move forward. A retaining wall 34 is disposed in the top cover 3 to define the front limit position of the baffle 8. Stop arms 931 which project upward are disposed at the lower positions of the slide ways 93 to, on one hand, define the lowest position to which the sliders 83 can slide (i.e., define the rear limit position of the baffle 8) and, on the other hand, ensure an enough height space between the supporting frame 9 and the top cover 3, so that the baffle 8 can move in the height space.

Figure 10:
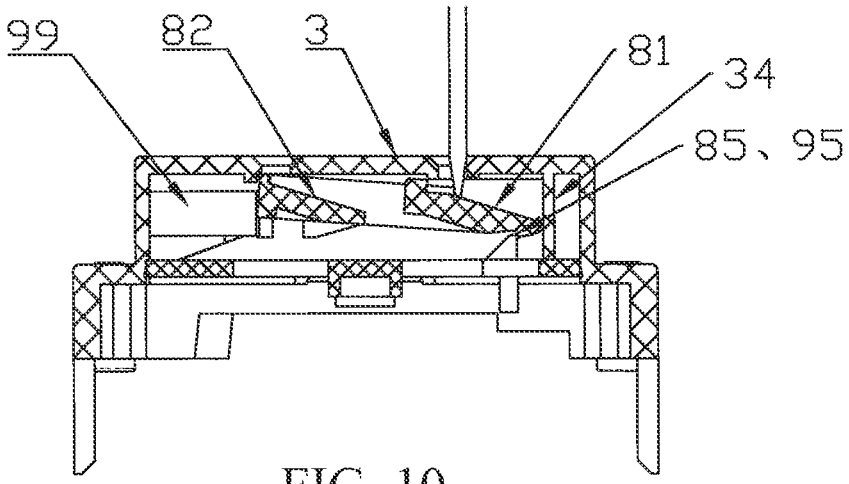
FIG. 10 and FIG. 11 are respectively schematic diagrams showing that the safety door plays a role of safety protection when stabbed by an iron wire.

As shown in FIG. 10, when a baby or child thrusts a conductive object (e.g., an iron wire) into the front power outlet, the baffle 8 moves like a seesaw at this moment since only the front slope 81 receives pressure, that is, the front slope 81 goes down, while the rear slope 82 goes up. Because a stop hook 85 extends downward from the front end of the baffle 8 and the front end of the supporting frame 9 is provided with stop walls 95, the stop hook 85 interferes with the stop walls 95 of the supporting frame 9 under the drive of the front slope 81 going down, and as a result, the baffle 8 cannot move backward, playing a role of safety protection.

Figure 11:
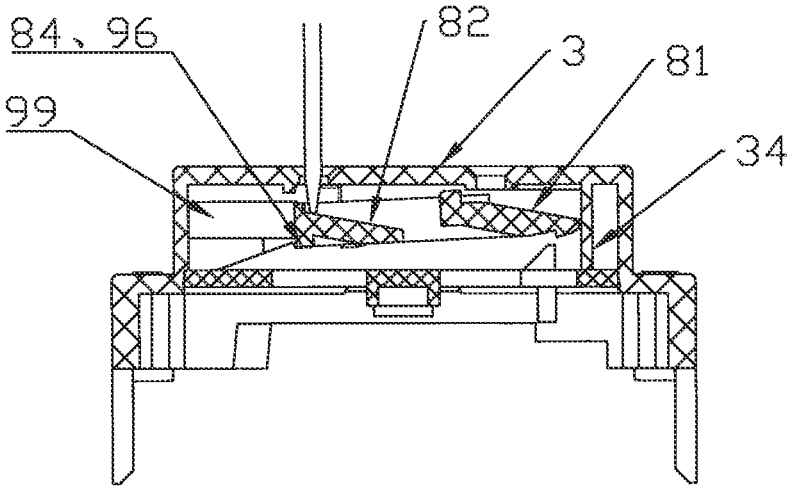

As shown in FIG. 11, when the baby or child thrusts the conductive object (e.g., an iron wire) into the rear power outlet, the baffle 8 moves like a seesaw at this moment since only the rear slope 82 receives pressure, that is, the rear slope 82 goes down, while the front slope 81 goes up.

Because both sides of the rear end of the baffle 8 are provided with a pair of supporting wings 84 and the rear end of the supporting frame 9 is provided with stop notches 96, the supporting wings 84 interfere with the stop notches 96 of the supporting frame 9 under the drive of the front slope 81 going down, and as a result, the baffle 8 cannot move backward, playing a role of safety protection. In addition, auxiliary slide ways 94 also extend from the rears of the stop notches 96, and the supporting wings 84 can slide in the auxiliary slide ways 94, so that the baffle 8 can steadily slide relative to the supporting frame 9.

Figure 12:
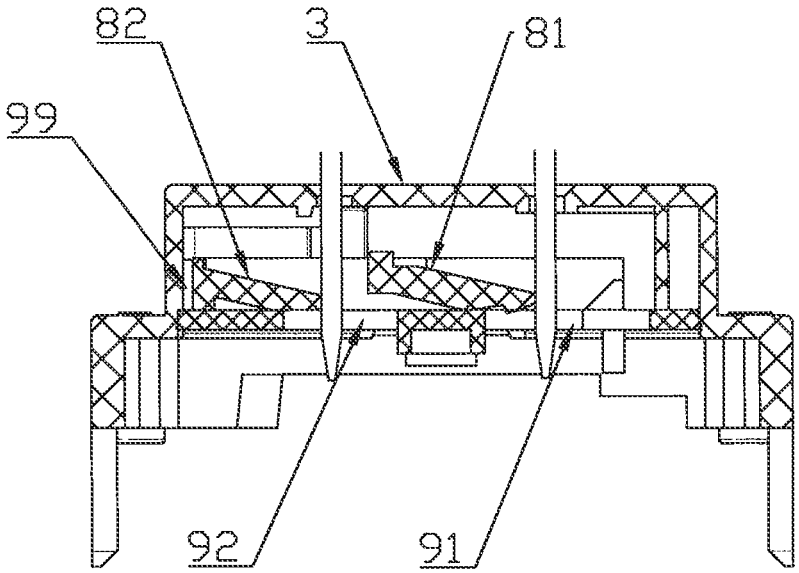
FIG. 12 is a schematic diagram of the action of the safety door when a plug is inserted.

FIG. 12 is a schematic diagram of the action of the safety door when a plug is inserted. Since the front slope 81 and the rear slope 82 simultaneously receive pressure, the seesaw is kept in balance, and the baffle 8 slides relative to the supporting frame 9, so that the plug passes through the front through hole 91 and the rear through hole 92, completing the operation of getting electricity.

The above description is merely illustrative rather than limitative for the present invention, and those of ordinary skill in the art should understand that many modifications, changes or equivalents can be made without departing from the spirit and scope defined by the claims, but shall all fall within the protection scope of the present invention.

The invention claimed is:

1. An improved structure of a ground fault circuit interrupter, a leakage protection action mechanism being disposed inside the ground fault circuit interrupter, the leakage protection action mechanism including a sleeve, a permanent magnet fixed at a position of one end of the sleeve, a soft magnet slidable in the sleeve, an elastic mechanism connected between the soft magnet and the sleeve and an action coil disposed outside the sleeve, and the ground fault circuit interrupter being further provided with a reset button capable of triggering the action coil, wherein a locking arm, which is provided with a stop surface, is also disposed inside the ground fault circuit interrupter, and a support body fixedly connected to the soft magnet is provided with a stop portion which can interfere with the stop surface that is moving downward;

the locking arm is also connected to an elastic element which in a normal state moves downward the stop surface of the locking arm to interfere with the stop portion of the support body so as to stop the soft magnet from moving toward the permanent magnet; and the locking arm can also be pushed down and driven by the reset button to moves upward the stop surface to, so that the stop portion no longer interferes with the stop surface.

2. The improved structure of the ground fault circuit interrupter of claim 1, wherein a middle portion of the locking arm is fixed by a torsion beam which forms the elastic element.

3. The improved structure of the ground fault circuit interrupter of claim 2, wherein a switching arm which can be pushed down by the reset button is disposed under the reset button, and one end of the switching arm is provided with a downward lug; and the locking arm is disposed under the switching arm, with one end being capable of coming into contact with the lug of the switching arm and the other end projecting downwards to form the stop surface.

4. The improved structure of the ground fault circuit interrupter of claim 1, wherein a back of the stop surface is provided with a slope, and/or a part of the stop portion which is connected to the back of the stop surface is provided with a slope.

5. The improved structure of the ground fault circuit interrupter of claim 1, wherein the support body is connected to a movable contact plate which can come into contact with a static contact plate fixed in position so that a load circuit of the ground fault circuit interrupter is connected;

the support body fixedly connected to the soft magnet is provided with a pair of accommodating recesses which are separately disposed in parallel, with one spring being disposed in each accommodating recess, wherein two movable contacts are respectively fixed at both ends of the movable contact plate, with one side of each movable contact abutting against the extended end of one of the springs, and a static contact being disposed opposite to the other side of each movable contact, and wherein the static contacts are fixed in position and connected to the load circuit.

6. The improved structure of the ground fault circuit interrupter of claim 1, wherein a safety door is arranged in each pair of power outlets of the ground fault circuit interrupter, and includes a baffle, a supporting frame and an elastic part, wherein the baffle is provided with a front slope and a rear slope which are in the same inclination direction and are separately disposed at the front and the rear, with a lower end of the front slope having no obstruction, and a lower end of the rear slope being open for simultaneous passage of a positive prong and a negative prong; a left slider and a right slider are disposed at a position between the front slope and rear slope of the baffle;

the supporting frame is provided with a front through hole and a rear through hole which are separately disposed at the front and the rear and respectively correspond to the positions of the front slope and the rear slope; a pair of slide ways are disposed respectively on the left side and right side of the supporting frame;

the baffle is disposed on the supporting frame, the sliders are connected to the slide ways, so that the baffle can slide relative to the supporting frame, and a pair of fulcrums are also formed at the positions where the sliders are in contact with the slide ways, so that the baffle can move like a seesaw on the supporting frame; and the elastic part abuts against the baffle, so that the sliders of the baffle receive an elastic force for returning to a higher position when located on the slide ways.

7. The improved structure of the ground fault circuit interrupter of claim 6, wherein the inclination direction of the bottoms of the sliders is opposite from the inclination direction of the front slope.

8. The improved structure of the ground fault circuit interrupter of claim 6, wherein a stop hook extends downward from a front end of the baffle, a front end of the supporting frame is provided with stop walls, and the stop hook can interfere with the stop walls of the supporting frame under the drive of the front slope going down, so that the baffle cannot move backward;

a pair of supporting wings are disposed at a rear end of the baffle, a rear end of the supporting frame is provided with a pair of stop notches, and the supporting wings can interfere with the stop notches of the supporting frame under the drive of the front slope going down, so that the baffle cannot move backward.

9. The improved structure of the ground fault circuit interrupter of claim 8, wherein auxiliary slide ways also extend from the rears of the stop notches, and the supporting wings can slide in the auxiliary slide ways, so that the baffle can steadily slide relative to the supporting frame.

* * * * *